US011771142B2

(12) United States Patent
Patmore

(10) Patent No.: US 11,771,142 B2
(45) Date of Patent: Oct. 3, 2023

(54) FABRIC GARMENT FOR MEN

(71) Applicant: Uber Holdings Limited, Braintree (GB)

(72) Inventor: Duncan Patmore, Essex (GB)

(73) Assignee: UBER HOLDINGS LIMITED, Braintree (GB)

( * ) Notice: Subject to any disclaimer, the term of this patent is extended or adjusted under 35 U.S.C. 154(b) by 145 days.

(21) Appl. No.: 17/312,578

(22) PCT Filed: Dec. 11, 2019

(86) PCT No.: PCT/GB2019/053506
§ 371 (c)(1),
(2) Date: Jun. 10, 2021

(87) PCT Pub. No.: WO2020/120958
PCT Pub. Date: Jun. 18, 2020

(65) Prior Publication Data

US 2021/0337883 A1 Nov. 4, 2021

(30) Foreign Application Priority Data

Dec. 11, 2018 (GB) ..... 1820130

(51) Int. Cl.
*A41B 9/02* (2006.01)

(52) U.S. Cl.
CPC ..... *A41B 9/023* (2013.01); *A41B 9/026* (2013.01)

(58) Field of Classification Search
CPC ..... A41B 9/023; A41B 9/026; A41B 9/02
See application file for complete search history.

(56) References Cited

U.S. PATENT DOCUMENTS 2,176,790 A * 10/1939 Coppel ..... A41B 9/02 2/403
2,214,578 A * 9/1940 Davis ..... A41B 9/02 2/403
2,243,643 A * 5/1941 Murphey ..... A41B 9/02 2/403
2,349,426 A * 5/1944 Harwood ..... A41B 9/02 2/403

(Continued)

FOREIGN PATENT DOCUMENTS

GB 2366988 A 3/2002
JP S53164307 U 12/1978

*Primary Examiner* — Richale L Quinn
(74) *Attorney, Agent, or Firm* — Renner, Kenner, Greive, Bobak, Taylor & Weber

(57) ABSTRACT

A fabric garment for men configured to be worn around the pelvic area of a wearer and having one or more leg opening. The garment comprises a concealing panel and an external front portion configured to cover the genital organs of a wearer and partly overlying the concealing panel. An access is defined between the front portion and the concealing panel. First and second linear access edges are provided on the front portion, together defining a V-shape. Two intersecting lines of support stitching are also provided on the front portion, adjacent the access edges, the lines extending beyond the vertex of the access edges so as to form an X-shape. The front portion is at least partly resiliently deformable so as to facilitate access between the concealing panel and the X-shape, in use, for at least part of the external male genitalia.

15 Claims, 3 Drawing Sheets

(56) References Cited

U.S. PATENT DOCUMENTS

| | | | | | |
|---|---|---|---|---|---|
| 2,416,108 | A | * | 2/1947 | Lloyd | A41B 9/02 2/403 |
| 3,038,471 | A | * | 6/1962 | Van Horne | A41B 9/02 2/403 |
| 3,166,764 | A | * | 1/1965 | Stedman | A41B 9/02 2/403 |
| 3,174,482 | A | * | 3/1965 | Parrott | A41B 9/02 2/404 |
| 3,207,155 | A | * | 9/1965 | Casey | A41B 9/026 2/403 |
| 3,496,576 | A | * | 2/1970 | Artzt | A41B 9/02 2/403 |
| 3,654,634 | A | * | 4/1972 | Torres | A41B 9/02 2/403 |
| D482,512 | S | * | 11/2003 | Slautterback | D2/712 |
| 10,085,491 | B2 | * | 10/2018 | Howard | A41B 9/026 |
| D960,495 | S | * | 8/2022 | Patmore | D2/712 |

* cited by examiner

FABRIC GARMENT FOR MEN

This invention relates to a fabric garment for men and in particular, to an improved fabric garment for men which serves to enhance the wearer's comfort and make access convenient.

The present invention has been developed for use on male undergarments in general, and specifically, men's underwear. The invention will therefore be described herein with particular emphasis on underwear, though it should be understood that the fabric garment of the present invention may equally comprise other types of clothing, such as trousers and shorts.

Many types of commercially available underwear for men incorporate an opening at the crotch. The opening, which is often referred to as a "fly", provides access for male genitalia for sanitary functions. However, the location and configuration of the opening in such underwear tends to be uncomfortable for the wearer and makes accessing the genitalia cumbersome and time consuming.

Various attempts to address these problems have been made with underwear designed with openings in the side regions. However, existing garments suffer from shortcomings which at best make them uncomfortable for the user to wear, and at worst leave the user prone to injury. One such shortcoming derives from the location of the opening; where that location is at a side region of the underwear, the wearer needs to carry out an unnatural and often uncomfortable manoeuvre in order to provide access, and where the location is centrally disposed, a fastener, such as buttons is typically required in order to reduce the risk of accidental exposure. Such configurations can be particularly problematic for elderly or disabled persons, who may require assistance.

Another shortcoming stems from the typical construction of male undergarments from conventional elasticated fabric material. In order to prevent the fabric material unravelling, the undergarments are generally formed with a thick hem or seam—generally referred to herein as a "rib"—around the upper and/or lower apertures through which the user's legs pass when putting the undergarments on. As underwear is generally designed to be worn reasonably tightly against the users skin under trousers, these ribs can press into the skin of the user's external genital organs when worn, causing severe discomfort.

A further drawback of existing underwear for men is that they do not tend to concentrate on providing support where it is most required, around the genital organs. It would be beneficial to provide underwear which maximises comfort and support to the genital area by isolating the penis from the scrotum.

The present invention seeks to address the above issues by providing an improved fabric garment for men.

According to this invention, there is provided a fabric garment for men configured to be worn around the pelvic area of a wearer and having one or more leg opening, the garment comprising:

- a concealing panel;
- an external front portion configured to cover the genital organs of a wearer and partly overlying the concealing panel;
- an opening defined between the front portion and the concealing panel;
- first and second linear access edges on the front portion providing access to the opening, the first and second access edges together defining a V-shape; and

- two intersecting lines of support stitching on the front portion, adjacent the access edges, the lines extending beyond the vertex of the access edges so as to form an X-shape, wherein the front portion is at least partly resiliently deformable so as to facilitate access between the concealing panel and the X-shape, in use, for at least part of the external male genitalia.

Preferably, the garment has two leg openings, one for each leg of the wearer. The part of the front portion which overlies the concealing panel may be configured to overlap the concealing panel such that the opening is concealed until access is initiated. The visible part of the concealing panel is ideally that part which is located above the vertex of the access edges, when the garment is worn.

An important aspect of the present invention that the opening is generally upwardly directed such that it provides the ability to access the interior through the opening generally from above. The provision of the v-shaped access edges forms a convenient single point at the vertex for the wearer to manipulate the garment and gain access. Ideally the v-shape is orientated upwards (with respect to a wearer standing upright). This configuration is easier to use and greatly improves the time taken to access the interior of the garment. Preferably, the vertex of the access edges is centrally disposed on the front of the garment. This configuration provides a convenient and comfortable position at which the wearer can access the opening.

Preferably the support stitching is on the front portion, below the opening. Access to the opening is preferably initiated by manoeuvring the first and second access edges of the front portion in a downward direction away from the concealing panel. The support stitching preferably gives strength and elasticity to the fabric, thus enabling the material to resiliently retract back to the original non-stretched position once the access edges are released. The provision of an X-shape for the support stitching effectively provides four points of anchoring (at the proximal ends of the linear stitch lines) for enhanced strength.

Preferably, the support stitching comprises a flatlock over-seam so that the front portion of the fabric garment has no perceptible ribs. The term "perceptible" is used in this context to mean that no discomfort will be caused to the user by the support stitching on the front portion in contact with the skin, when the fabric garment is worn. This type of stitching produces a flat seam which serves to avoid irritation and the risk of chaffing. Ideally, the user will be substantially unable to feel the support stitching through his skin, when the garment is worn.

The fabric garment may further comprise a griping tab extending at the vertex of the first and second linear access edges. The presence of a griping tab may enable the front panel to be manipulated quickly and with ease. This may be particularly beneficial in instances where the garment is worn underneath other clothing, trousers for example, with a fly region for easy access to the external genitalia.

The fabric garment may be any item of clothing designed to be worn around the pelvic area. Ideally, the garment is designed to be worn next to the skin. The garment may be an undergarment, designed to contact the wearer's skin and worn beneath outer clothes. More preferably, the garment comprises men's underwear. The underwear may comprise boxer briefs or trunks, with the latter designed to be worn lower on the waist.

Preferably the concealing panel has a lower edge which extends into the interior of the fabric garment. The front portion is required to overlie the concealing panel to a sufficient extent to prevent accidental exposure of the wearer's skin whilst also facilitating easy access through the opening, when required. The inventor has discovered that the distance between the vertex of the access edges and the lower edge of concealing panel, immediately below the vertex, is very important to ensure that the concealing and ease of access requirements are met. The distance may depend on the stretch of the fabric and the type of garment. Preferably, the distance is between 30 mm-45 mm. Where the fabric garment comprises boxer briefs, the distance between the vertex and the lower edge of the concealing panel may be between 35 mm-45 mm. In this case, preferably, the distance is substantially 40 mm. On the other hand, where the fabric garment comprises trunks, the distance between the vertex and the lower edge of the concealing panel may be between 30 mm-40 mm. In this case, preferably, the distance is substantially 35 mm. These are appropriate for standard adult clothing but may be adjusted accordingly for smaller or larger wearers.

The distance between the top of the concealing panel and the vertex of the first and second linear edges is also an important factor. Preferably, the distance is between 20 mm-35 mm. Where the fabric garment comprises boxer briefs, the distance between the top of the concealing panel and the vertex may be between 25 mm-35 mm. In this case, preferably, the distance is substantially 30 mm. On the other hand, where the fabric garment comprises trunks, the distance between the top of the concealing panel and the vertex may be between 20 mm-30 mm. In this case, preferably, the distance is substantially 25 mm. Again, these are appropriate for standard size adult clothing but may be adjusted accordingly for smaller or larger wearers.

Preferably, the fabric garment further comprises an elasticated waist band connected to the concealing panel and to the front panel. This arrangement may serve to enhance the wearers comfort and to ensure a snug fit around the waist and pelvic area so that pulling of the access edges of the front portion in a downwardly direction, away from the concealing panel, does not inadvertently also pull down the fabric garment. The elasticated waist band may be suitably sized depending on the garment size. An appropriate width for the waistband may be approximately 40 mm.

To enhance the wearers comfort further, the fabric garment may further comprise an inner support panel. The inner support panel may comprise a flexible mesh or mesh-like fabric. This type of material will ensure that the skin can breathe and prevents sweat build up, which can lead to infection and/or bad odours. In a preferred arrangement, the inner support panel is configured to define an aperture for the penis, thereby separating it from the testicles. This configuration forms a compartment effectively facilitating isolation of the penis. This not only improves comfort but also hygiene as it provides greater ventilation for the wearer. Moreover, the provision of the inner support panel may serve to increase the perceived size of the pelvic area, which may be beneficial for the wearers self-esteem or may be appealing to others.

The inner support panel may further comprise a base panel, defining the bottom of the penis aperture. The base panel preferably forms a platform for supporting the wearers testicles when the garment is worn. This configuration considerably increases the wearers comfort.

The garment of the present invention provides enhanced comfort and provides convenient and quick access for male genitalia for sanitary functions. The garment may be made from any suitable fabric. Preferably the fabric is comfortable and provides a level of resiliency to ensure longevity of the garment.

Whilst the garment has been designed specifically for use by men it should be appreciated that the present invention is not restricted per se in this sense and can be worn by others, without departing from the scope of the invention.

By way of example only, an embodiment of this invention will now be described in detail, reference being made to the accompanying drawings in which:—

Figure 1:
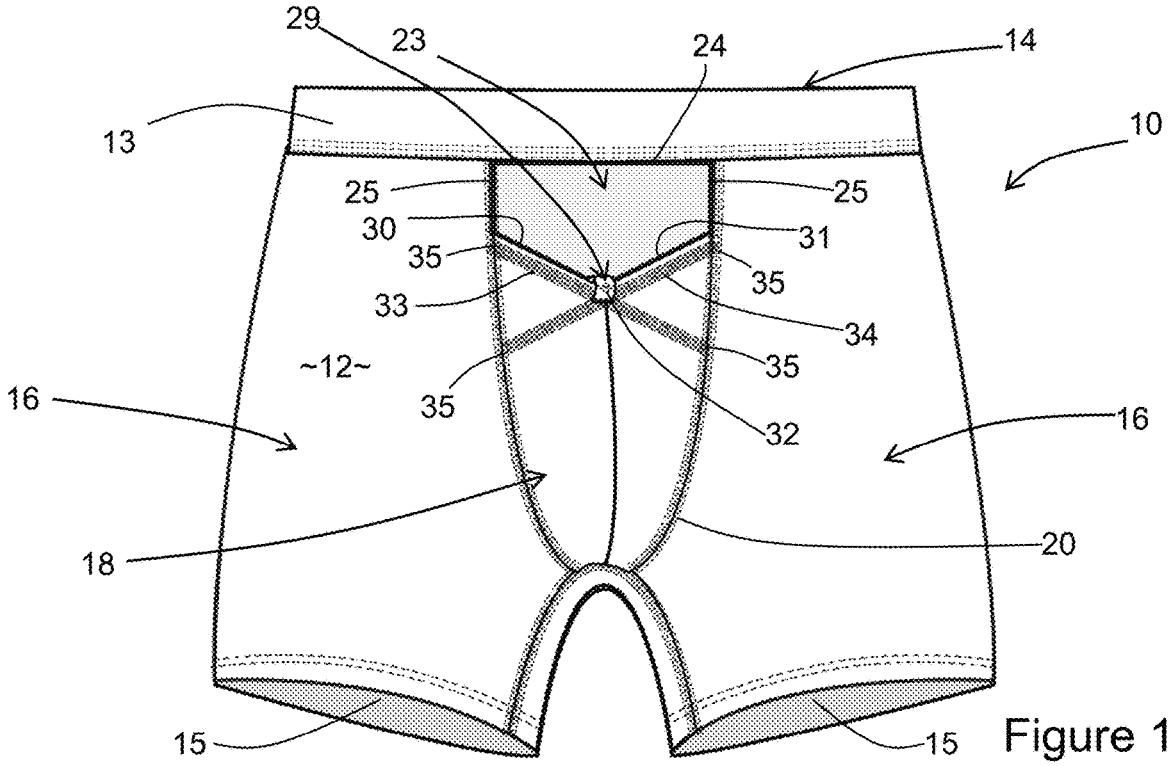
FIG. 1 is a front view of a pair of men's boxer briefs according to a first embodiment of the present invention.
Figure 2:
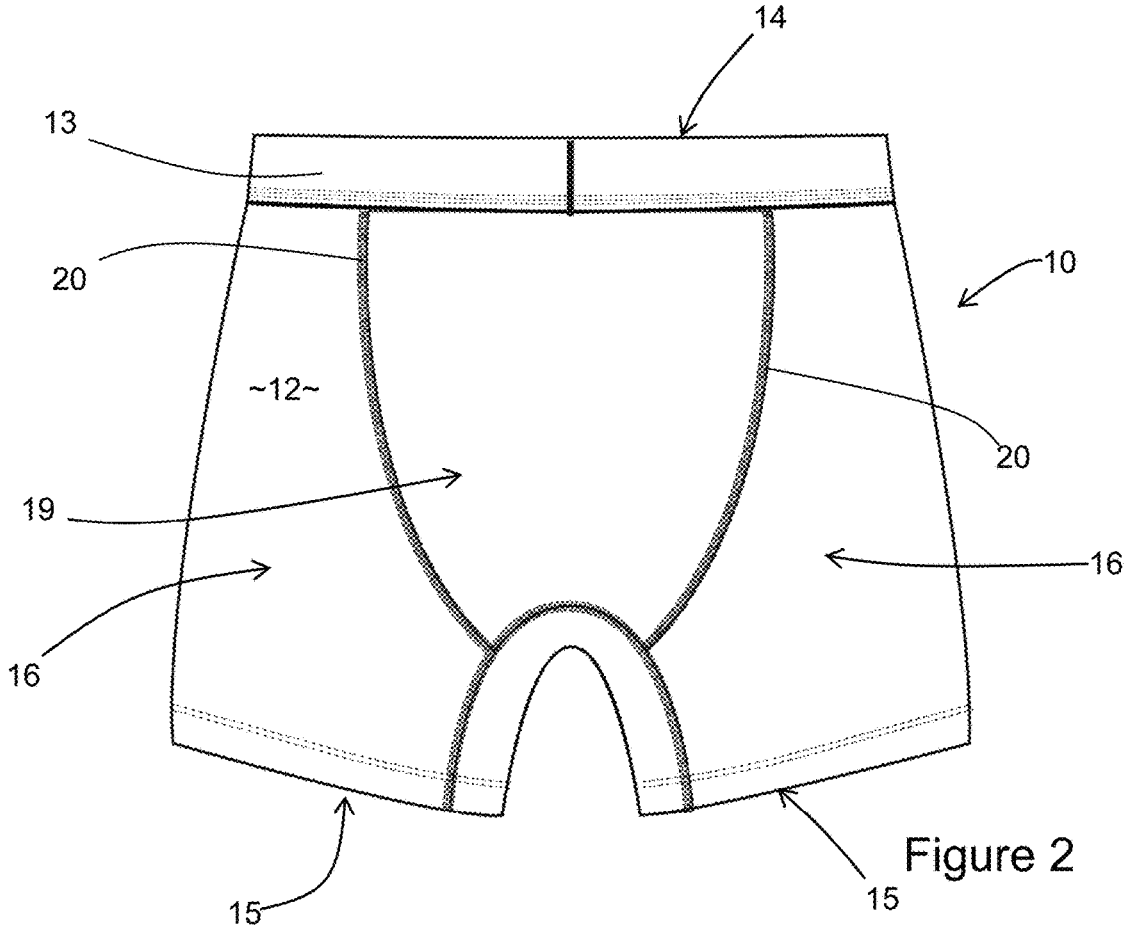
FIG. 2 is a rear view of the boxer briefs of FIG. 1.
Figure 3:
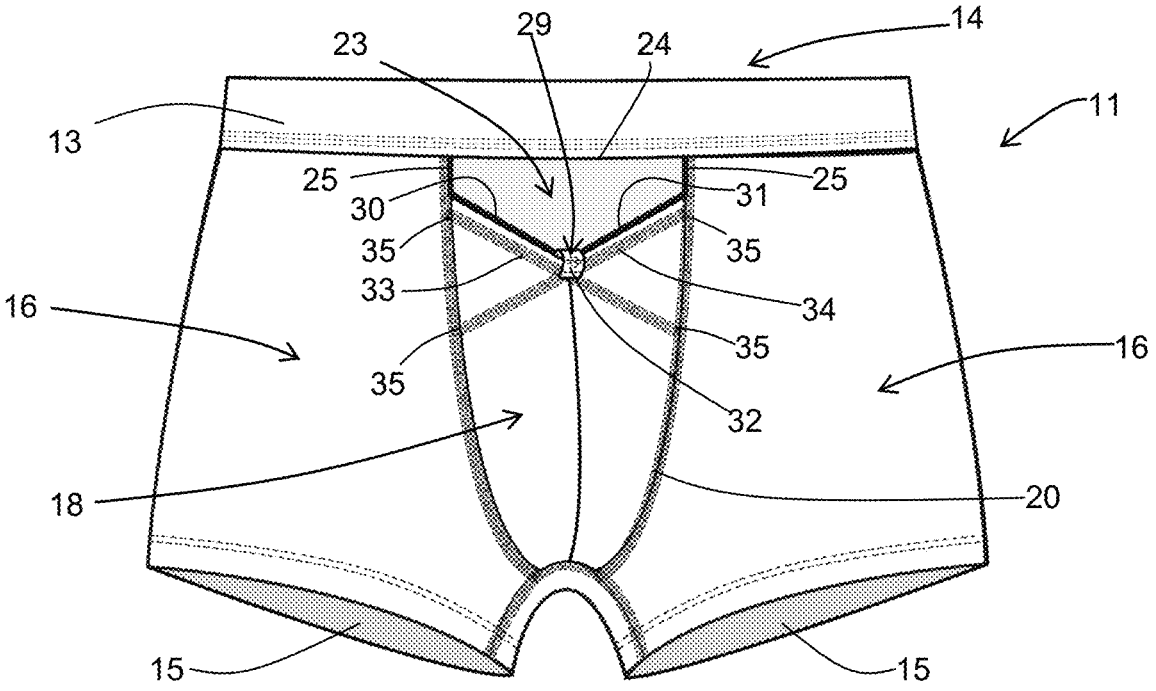
FIG. 3 is a front view of a pair of men's trunks according to a second embodiment of the present invention.
Figure 4:
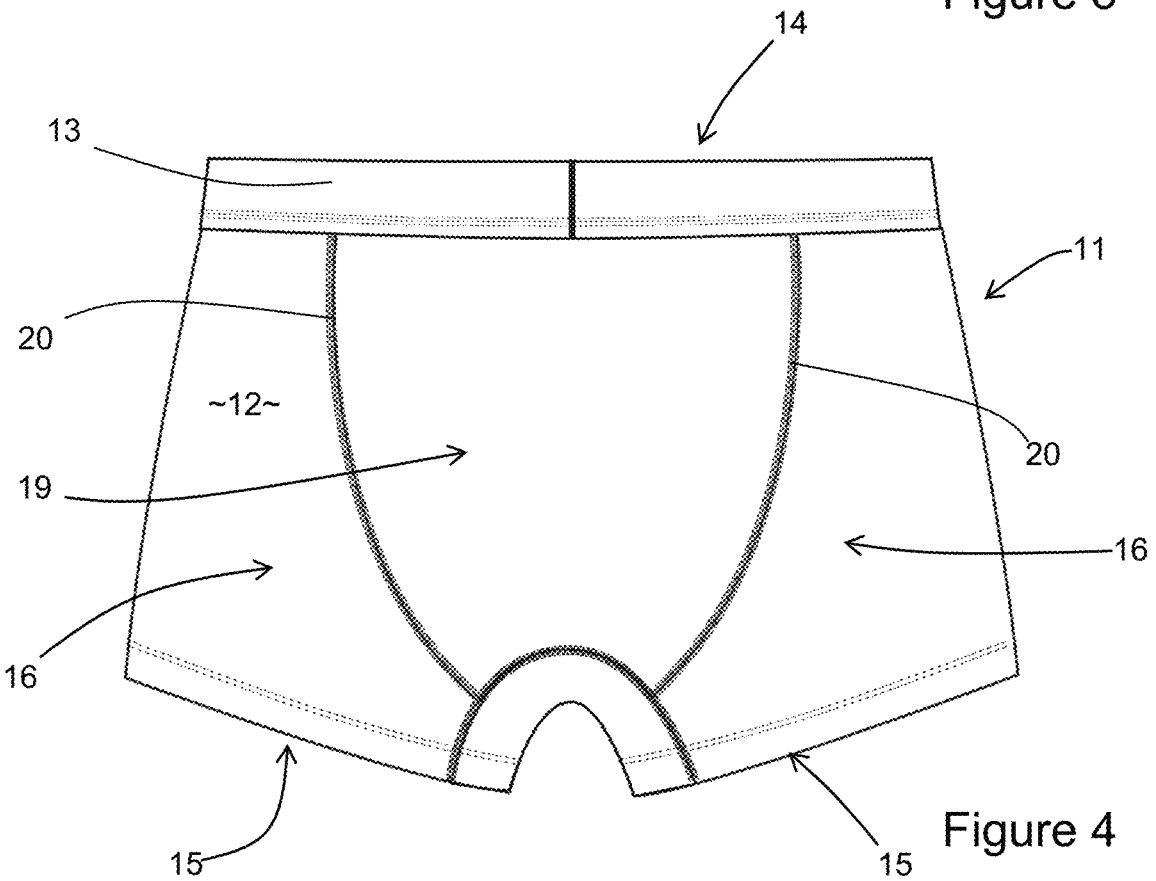
FIG. 4 is a rear view of the boxer briefs of FIG. 3.

Referring initially to FIGS. 1 to 4, there are shown two forms of fabric garment, namely a pair of boxer briefs, generally indicated 10 in FIGS. 1 and 2 and a pair of trunks, generally indicated 11 in FIGS. 3 and 4. The boxer briefs 10 and trunks 11 each comprise a fabric construction 12, having an elasticated waist band 13 defining an upper aperture 14 for the waist of a wearer and two lower apertures 15, defined by leg regions 16, for receipt of a wearer's legs. The waist band 13 of the trunks 11 is intended to be worn a little lower than the waist band 13 of the boxer briefs 10 and the length of the leg regions 16 of the trunks 11 is less than that of the boxer briefs 10. Other than these differences, the configuration of the boxer briefs 10 and the trunks 11 is substantially the same and so the remaining features described, unless specified otherwise, shall be deemed as applicable to both and shall be described collectively with reference to the "underwear 10, 11".

Referring now to all of the Figures, the underwear 10, 11 is provided with a front portion 18 which is designed to cover the genital region of a wearer and a rear portion 19 arranged to cover the wearer's buttocks. The front and rear portions 18, 19 are defined by flatlock stitching 20, which may serve to add strength in the pelvic and buttock areas and may also serve a connective function, in instances where the front and rear portions 18, 19 comprise separate material sections. The flatlock stitching 20 ensures that the seams have no perceptible ribs.

A substantially rectangular concealing panel 23 extends from the waist band 13, along a longitudinal edge 24, and is also connected to the leg regions 16 at each side edge 25. The remaining longitudinal edge 26 of the concealing panel 23 is at least partly a free unconnected edge. The concealing panel 23 may be formed from a shell fabric to enhance comfort for the wearer. The front portion 18 partly overlies the concealing panel 23 so that, when the underwear 10, 11 is worn, the genitalia remains concealed.

The front portion 18 overlaps part of the concealing panel 23 so that an opening 27 is defined between the concealing panel 23 and the front portion 18 into the interior of the underwear 10, 11. The overlapping part of the front region 18 is terminated externally by two linear access edges 30, 31, configured to form a v-shape. The vertex 29 of the v-shaped access edges 30, 31 is centrally located on the front portion 18 of the underwear 10, 11. A gripping tab 32 is provided at the vertex 29 of the access edges 30, 31 to enable quick and easy access to the opening 27.

The distance between the vertex 29 of the access edges 30, 31 (identified by the griping tab 32) and the lower edge 26 of the concealing panel 23 is very important to ensure that the genitalia remains concealed when the underwear 10, 11 is worn but that access through the opening 27 can easily be had when required. The distance between the vertex 29 (identified by the griping tab 32) and the lower edge 26 of the concealing panel 23 is substantially 30-45 mm, depending on the elasticity of the fabric material and the type of garment.

Support stitching is provided by two intersecting lines 33, 34 immediately adjacent the access edges 30, 31, the lines of the support stitching 33, 34 extending beyond the vertex of the access edges 30, 31 so as to form an X-shape. The end regions 35 of the X-shape defined by the intersecting lines 33, 34 of the support stitching terminate at the support stitching 20 defining the front portion 18. These four connection points 35 effectively provide support to the X-shaped area and deliver enhanced strength.

Figure 5:
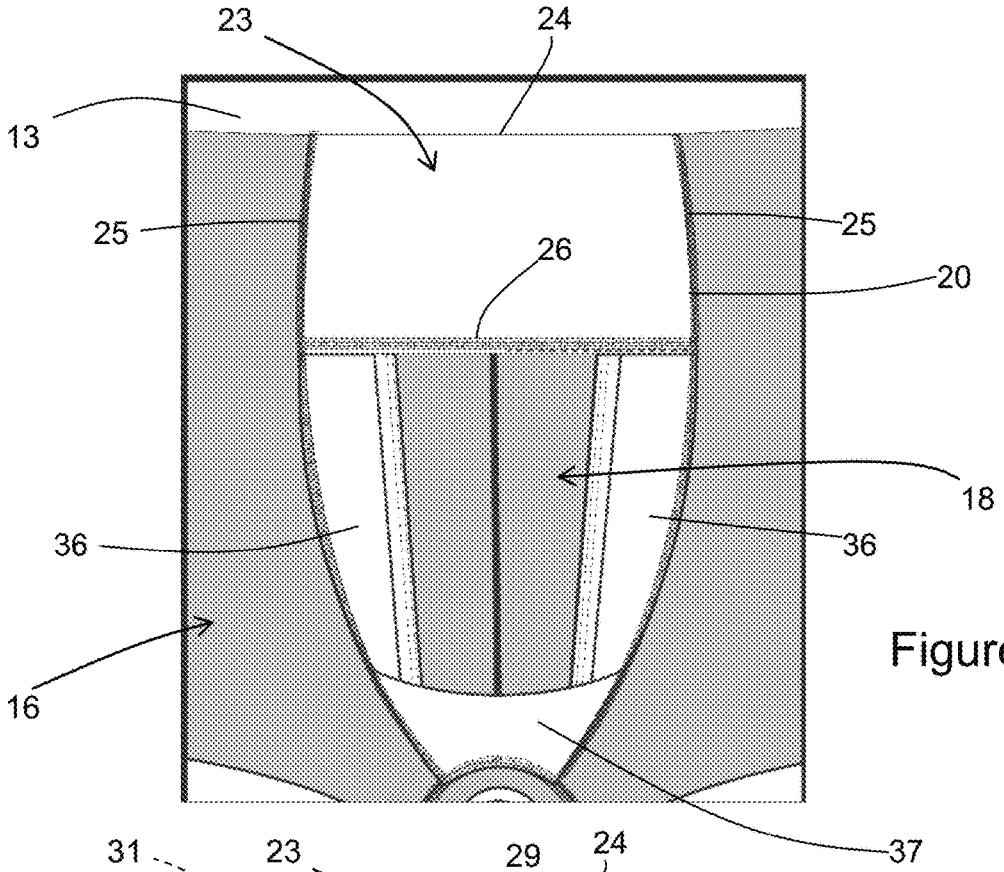
FIG. 5 is a sectional view of an internal part of the fabric garment of the present invention.
Figure 6:
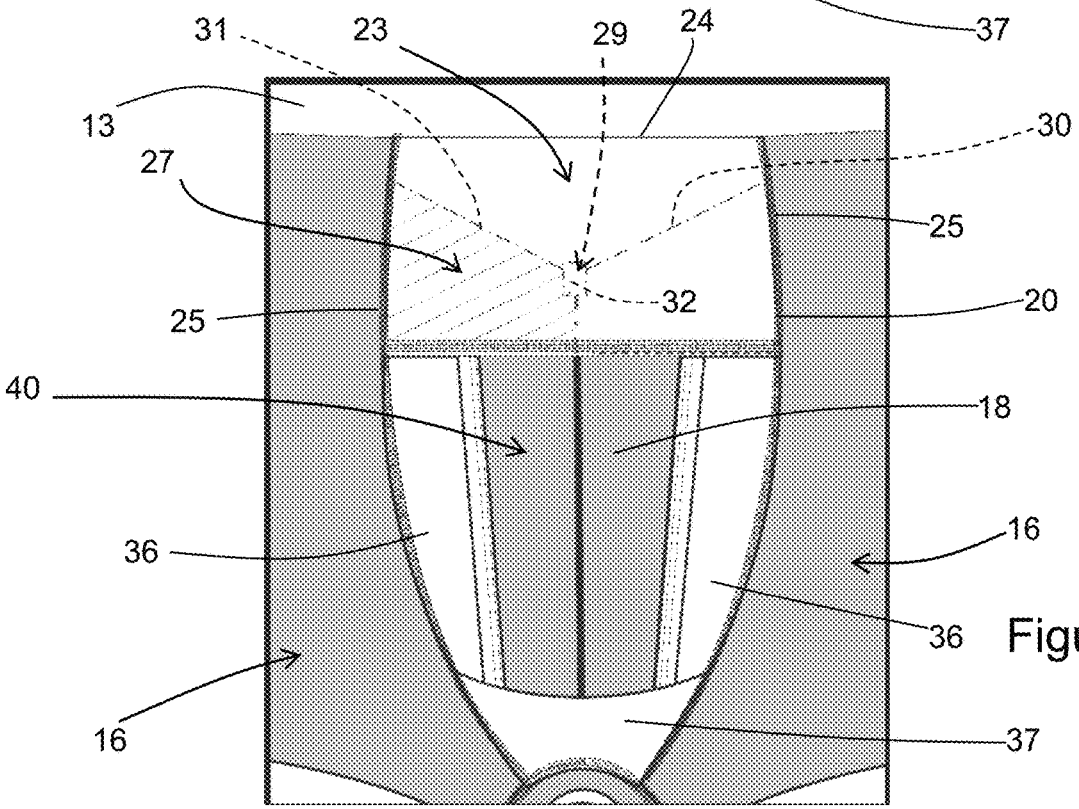
FIG. 6 is a sectional view of an internal part of the fabric garment of the present invention showing more clearly the relationship between the internal and external parts of the front section.

As best seen in FIGS. 5 and 6, the interior of the underwear 10, 11 includes an inner support panel. The inner support panel comprises a flexible mesh fabric which is connected to the leg region 16 by the support stitching 20 defining the front portion 18 and is connected to part of the lower edge 26 of the concealing panel 23. The inner support panel comprises two support slings 36 connected together at their lower ends by a base panel 37. An aperture 40 is defined between the support slings 36 and the base panel 37. The aperture 40 allows access to a compartment defined between inner support panel and the front portion 18 which is designed to receive the wearer's penis, thereby separating this part of the male genitalia from the testicles. The base panel 37 effectively operates as a shelf for supporting the testicles.

When the underwear 10, 11 is worn, the wearer can open/access the opening by pulling the griping tab 32 in a downward direction until the vertex 29 of the access edges 30, 31 passes the lower edge 26 of the concealing panel 23. This action reveals the opening 27 into the interior of the underwear 10, 11. The wearer is able easily and quickly to transfer the penis out of the opening 27 in order to carry out sanitary functions. The concealing panel 23 may also deform upwards to facilitate access. Thereafter, once the genitalia has been placed back in the interior of the underwear 10, 11, the resiliency of the underwear material and the presence and configuration of the support stitching 33, 34 will allow the access edges 31, 32 of the front portion 18 to return back to their original concealing arrangement.

As can be appreciated from the Figures and the description hereinbefore, the underwear 10, 11 seeks to improve access to the interior, when required in a speedy and effective manner. The configuration ensures a hygienic setting may be maintained and ensures modesty at all times. The wearer's comfort levels are greatly increased and the risk of injury is greatly reduced.

The invention claimed is:

1. A fabric garment (10,11) for men configured to be worn around the pelvic area of a wearer, to cover genital organs of the wearer, and having one or more leg opening (15), the garment comprising:

a concealing panel (23);

an external front portion (18) configured to cover the genital organs of the wearer and partly overlying the concealing panel (23);

an opening (27) defined between the front portion (18) and the concealing panel (23);

first and second linear access edges (30,31) on the front portion (18) providing access to the opening (27), the first and second access edges (30,31) together defining a V-shape; and two intersecting lines of support stitching (33,34) on the front portion (18), below the opening (27), and adjacent the access edges (30,31), the lines (33,34) extending beyond a vertex (29) of the access edges (30,31) so as to form an X-shape, wherein the front portion (18) is at least partly resiliently deformable so as to facilitate access between the concealing panel (23) and the X-shape, in use, for at least part of the genital organs.

2. A fabric garment (10,11) as claimed in claim 1 , wherein the opening (27) is centrally disposed on the front of the garment (10,11).

3. A fabric garment (10,11) as claimed in claim 1, wherein the support stitching (33,34) comprises a flatlock over-seam (20).

4. A fabric garment (10,11) as claimed in claim 1 wherein the concealing panel (23) includes a lower edge (26) and the distance between that and the vertex (29) on the overlying part of the front portion (18), is 30-45 mm when closed.

5. A fabric garment (10,11) as claimed in claim 1, further comprising a griping tab (32) extending from the vertex (29) of the first and second linear access edges (30,31).

6. A fabric garment (10,11) as claimed in claim 1, wherein the garment (10,11) comprises an undergarment.

7. A fabric garment (10,11) as claimed in claim 6, wherein the garment (10,11) comprises underwear.

8. A fabric garment (10) as claimed in claim 1, wherein the garment comprises boxer briefs (10).

9. A fabric garment (10) as claimed in claim 8, wherein the distance between a top (24) of the concealing panel (23) and the vertex (29) of the first and second linear access edges (30,31) is 30 mm when closed.

10. A fabric garment (11) as claimed in claim 1, wherein the garment comprises trunks (11).

11. A fabric garment (11) as claimed in claim 10, wherein the distance between a top (24) of the concealing panel (23) and the vertex (29) of the first and second linear access edges (30,31) is 25 mm when closed.

12. A fabric garment (10,11) as claimed in claim 1 further comprising an inner support panel (36).

13. A fabric garment as claimed in claim 12, wherein the inner support panel (36) comprises a flexible mesh fabric.

14. A fabric garment (10,11) as claimed in claim 12, wherein the inner support panel (36) defines an opening (40) for a penis to separate this part from the rest of the genital organs.

15. A fabric garment (10,11) as claimed in claim 14, wherein the inner support panel (36) comprises a base panel (37) configured in use to support the wearer's testicles.

* * * * *